US006259211B1

(12) United States Patent
McGarry

(10) Patent No.: US 6,259,211 B1
(45) Date of Patent: Jul. 10, 2001

(54) VENDING MACHINE FLUORESCENT TUBE MONITOR

(75) Inventor: Patrick J. McGarry, West Chester, PA (US)

(73) Assignee: Mars Incorporated, McLean, VA (US)

( * ) Notice: Subject to any disclaimer, the term of this patent is extended or adjusted under 35 U.S.C. 154(b) by 0 days.

(21) Appl. No.: 09/360,094

(22) Filed: Jul. 23, 1999

Related U.S. Application Data

(60) Provisional application No. 60/095,392, filed on Aug. 5, 1998.

(51) Int. Cl.[7] ..... H05B 37/02

(52) U.S. Cl. ..... 315/149; 364/479

(58) Field of Search ..... 315/119, 324, 315/247, 135, 149; 235/92; 62/74; 221/9, 150 R, 150 HC; 364/479, 464, 478, 189, 184; 250/222; 194/217, 10

(56) References Cited

U.S. PATENT DOCUMENTS

| | | | | |
|---|---|---|---|---|
| 3,569,933 | | 3/1971 | Longenecker et al. . | |
| 3,692,211 | * | 9/1972 | Flubacker | 221/9 |
| 3,761,706 | | 9/1973 | Frey . | |
| 3,867,628 | * | 2/1975 | Brown | 250/206 |
| 4,201,907 | * | 5/1980 | Otten | 235/92 |
| 4,220,412 | | 9/1980 | Shroyer et al. . | |
| 4,258,993 | | 3/1981 | Frank . | |
| 4,365,165 | * | 12/1982 | Vedova | 250/577 |
| 4,593,361 | * | 6/1986 | Otten | 364/479 |
| 4,734,625 | | 3/1988 | Geanous et al. . | |
| 4,810,936 | | 3/1989 | Nuckolls et al. . | |
| 5,023,515 | | 6/1991 | Olon et al. . | |
| 5,089,753 | | 2/1992 | Mattas . | |
| 5,193,901 | | 3/1993 | Stone . | |
| 5,197,793 | | 3/1993 | Stone . | |
| 5,237,171 | * | 8/1993 | Liva et al. | 125/227.1 |
| 5,544,024 | | 8/1996 | Wittern, Jr. et al. . | |
| 5,548,398 | | 8/1996 | Gaboury . | |
| 5,614,790 | | 3/1997 | Fleck, Sr. et al. . | |
| 5,731,665 | | 3/1998 | Pruett . | |
| 5,780,842 | * | 7/1998 | Murphey | 250/222.1 |
| 5,931,003 | * | 8/1999 | Newman et al. | 62/74 |

* cited by examiner

*Primary Examiner*—Don Wong
*Assistant Examiner*—Chuc Tran
(74) *Attorney, Agent, or Firm*—Fish & Richardson P.C.

(57) ABSTRACT

A device and method for detecting the viability of a fluorescent light tube of a vending machine is described. A light tube detector circuit includes a photodetector, a circuit means to compensate for ambient light connected to the photodetector, and an output line. A microcontroller may be used to monitor the phase shifts in the pulses generated by the light tube detector circuit, and to determine when one or more fluorescent light tubes are going bad.

13 Claims, 2 Drawing Sheets

VENDING MACHINE FLUORESCENT TUBE MONITOR

This application claims priority from U.S. provisional application No. 60/095,392 filed on Aug. 5, 1998.

BACKGROUND OF THE INVENTION

Vending machines in the field include interior fluorescent lamps that illuminate a large front panel typically having a sign advertising the items available for vending. These illuminated vending machines attract consumers. But studies show that vending machine sales drop off dramatically when one or more of the lamps go out because customers perceive that the vending machine is broken. Thus, there is a need for a device to alert the vending machine owner when one or more of the lamps are showing signs of failing.

SUMMARY OF THE INVENTION

The invention concerns a non-contact fluorescent light tube detector (FLD) circuit for mounting within a vending machine. In particular, a photodetector monitors one of the fluorescent tubes, and is connected to a means for compensating for ambient light entering through the front panel. An output signal indicative of the status of the light tubes is generated on an output line. The output line may be connected to a microcontroller, such as a digital signal processor, a microprocessor or other control circuit, which monitors the phase shifts in the pulses generated by the FLD circuit. Based on the output of the FLD circuit, the microcontroller can determine when one or more fluorescent light tubes is going bad. In one implementation, the detector circuit may be housed in a collimator tube.

An implementation of a non-contact fluorescent light tube detector circuit for a vending machine includes a photodetector, circuit means connected to the photodetector to compensate for ambient light entering through the front panel, and an output line.

Implementations of the invention may include one or more of the following features. The light detector circuit may be housed within a collimator tube. The circuit means for compensating for ambient light may be an automatic gain control circuit, or may be a high pass filter. A microcontroller may be included to monitor the phase shifts in the pulses generated by the detector circuit, and may generate a fluorescent tube failure signal if at least one fluorescent light tube is faulty. The tube failure signal may be transmitted to a remote site. The microcontroller may be operable to detect when mains power has been removed to minimize false fluorescent tube failure signals. The microcontroller may also be operable to monitor a jitter signal for a predetermined time interval and to generate the fluorescent tube failure signal if the jitter exceeds a predetermined threshold value within the time interval. Alternately, the microcontroller may calculate a time interval based on monitored activity and use the time interval to monitor a jitter signal and then generate a fluorescent tube failure signal if the jitter exceeds a predetermined threshold value.

In another implementation, disclosed is a method for detecting when at least one fluorescent light tube in a vending machine is failing. The method includes positioning at least one fluorescent light tube detector adjacent at least one of the fluorescent light tubes, generating signals with the light tube detector, measuring the timing of a cycling waveform induced by the fluorescent light tube to detect any jitter, and generating a fluorescent light tube is failure signal if a jitter condition is detected.

Implementations of the method may include one or more of the following features. The jitter condition may comprise monitoring the jitter for at least one predetermined time interval, and indicating fluorescent tube failure if the jitter exceeds a predetermined threshold amount within the time interval. Alternately, the jitter condition may comprise monitoring the jitter for at least one calculated time interval, and indicating fluorescent tube failure if the jitter exceeds a predetermined threshold amount within the calculated time interval. The method may also include indicating that a fluorescent light tube has failed if no signals are detected and mains power has not been removed. The method may also include transmitting the failure signal to a remote location, and an audit system may transmit the failure signal. The method may further include logging the total amount of time that a fluorescent light tube has been illuminated, and transmitting a warning signal indicating that a light tube is nearing the end of its useful life if the time logged exceeds a predetermined threshold.

Advantages of the invention include the ability to measure the timing of a 60 cycle waveform (50 cycles in parts of Europe), such that any jitter detected in the timing pulses, or detection of missing pulses, indicates a fluorescent tube that is flickering. Such flickering is an indication that the fluorescent tube is about to fail, and thus a vending machine owner can be notified in a timely manner to install a new tube. Further, the FLD does not contact or couple to any of the fluorescent light tubes, which means that it can be retrofit to existing machines in the field, and that no special adaptations of the light tubes is required.

The invention also detects that a tube has failed, and the information can be used by the microprocessor to request service. In addition, the amount of time that a particular tube has been illuminated can be logged, which can be used to predict the useful life remaining in the fluorescent tube.

BRIEF DESCRIPTION OF THE DRAWINGS

Like reference numbers and designations in the various drawings indicate like elements.

DETAILED DESCRIPTION

Figure 1:
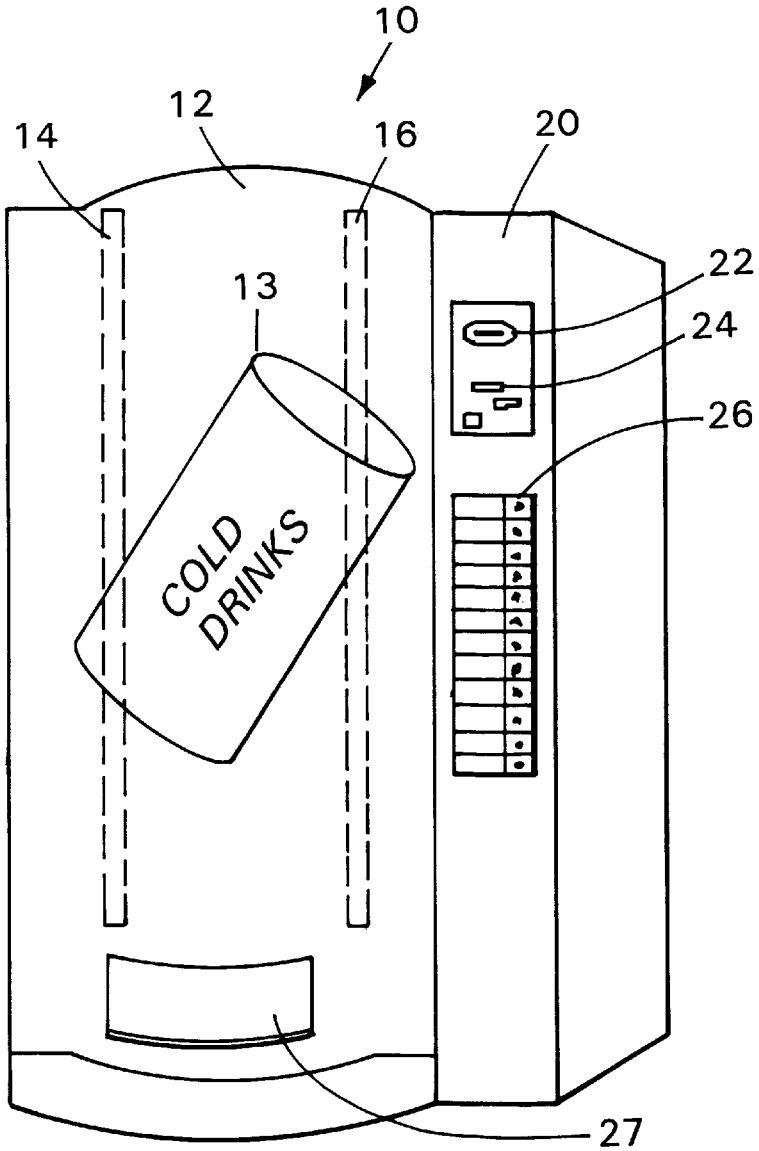
FIG. 1 is an example of a soft drink vending machine that includes a backlighted display panel.

FIG. 1 is an example of a soft drink vending machine 10 that includes a backlighted display panel 12. The display panel is typically made of a translucent plastic or fiberglass material, and typically includes artwork 13 and/or advertising copy pertaining to the items for sale housed within the vending machine. Fluorescent light tubes 14 and 16, shown in dotted lines, are typically mounted to an interior housing or to front panel support members within the vending machine, and extend substantially the entire height of the display panel. The fluorescent light tubes receive power from a suitable electrical AC power source to backlight the display panel and illuminate the vending machine.

FIG. 1 also shows a transaction panel 20 that typically includes payment insertion means such as a bill entryway 22, a coin slot 24, and contains item selection switches 26. Once payment is tendered and an item selected, a vend occurs and the consumer retrieves the chosen item from a delivery area 27.

Figure 2:
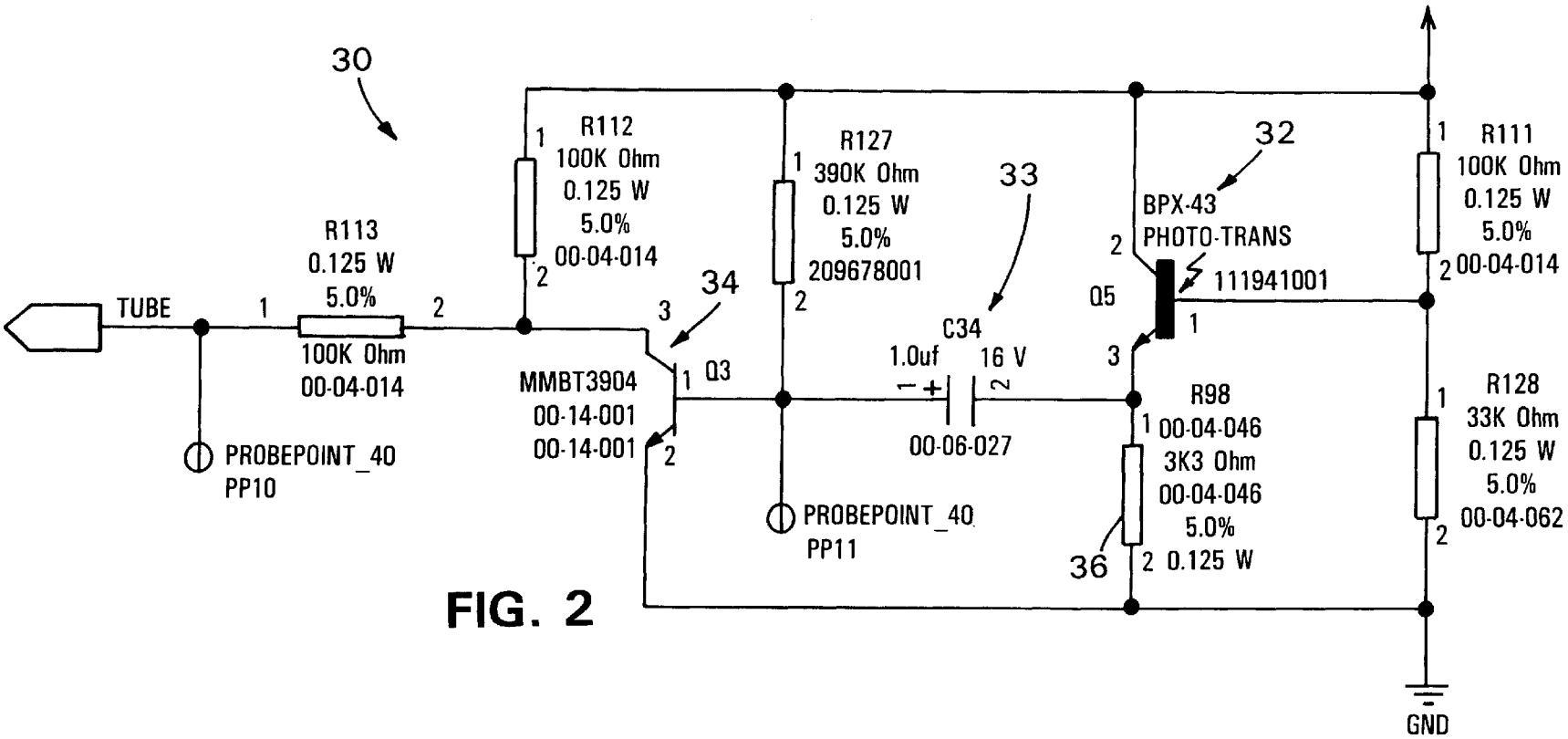
FIG. 2 is a schematic circuit diagram of an implementation of a fluorescent light tube detector (FLD) according to the invention, for monitoring a fluorescent light tube.

FIG. 2 is a schematic circuit diagram of an implementation of a fluorescent light tube detector (FLD) 30 for monitoring the condition of one of the fluorescent light tubes in a vending machine. The FLD 30 includes a phototransistor 32 AC-coupled through a capacitor 33 to an amplifier 34. The amplifier operates to amplify the signal generated by the phototransistor induced by a 60-cycle light frequency of the fluorescent tube emissions. Thus, the phototransistor 32 is tuned to detect the fluorescent light from the tube, and converts it into electrical signal that is a 60 Hertz (Hz) square wave (50 Hz in parts of Europe). The electrical signal may have a fifty percent duty cycle, for example, 8.3 milliseconds (ms) ON and 8.3 ms OFF.

Referring again to FIG. 2, the phototransistor 32 is connected in common-collector (i.e. emitter-follower) configuration to develop a square-wave signal across the emitter resistor 36. The amplitude of this generated signal is directly proportional to the intensity of the detected light. This square-wave waveform may be provided to a microcontroller, such as a digital signal processor (DSP) or a microprocessor (not shown) in the vending machine. The microcontroller may be part of, or connected to, a vending machine controller which monitors various functions of the vending machine, or may be connected to some other monitoring control circuitry.

Sunlight can affect conventional light-detecting devices and, since it is a constant source, presents itself as a DC signal source. Thus, the signal from the photodetector is AC-coupled through capacitor 33 to an amplifier 34 to eliminate any ambient light that may enter through the front panel. The capacitor and amplifier operate as an automatic gain control means so that accurate data about the fluorescent tube light is output. A high pass filter circuit could also be used to compensate for ambient light.

The FLD can be added to existing vending machines or to newly manufactured machines, and is removable as an accessory. The FLD can be suitably mounted to the vending machine interior at a range of distances from a fluorescent tube of from approximately six inches to about three feet, although other locations for mounting are possible. Due to the manner in which the fluorescent tubes 14 and 16 are mounted in the vending machine, when one of the fluorescent tubes starts to flicker, it will interact with the others. Thus, the FLD can detect that one of the fluorescent lamps is failing even though the fluorescent tube lamp that is causing the flickering condition is not being directly monitored.

Figure 3:
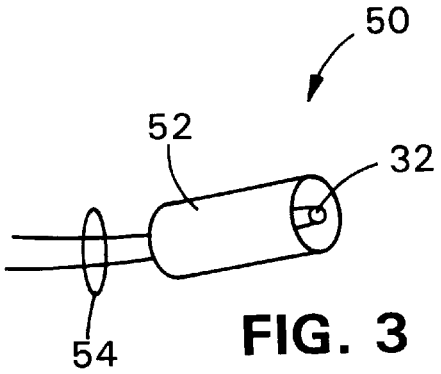
FIG. 3 illustrates an implementation of the invention mounted within a collimator tube.

FIG. 3 illustrates an implementation 50 of the invention mounted within a collimator tube 52. The photodetector 32 may be positioned at one end of the tube, as shown, and the output leads 54 may extend from the other end for connection to a microcontroller. As explained above, placement of the collimator tube adjacent to one of the fluorescent tubes is adequate to monitor all of the fluorescent lighting tubes in the vending machine.

The invention also detects when a fluorescent tube fails, and the information can be used by the microcontroller to generate a tube failure signal in order to request service. In addition, information such as the amount of time that a particular fluorescent tube has been illuminated can be logged, and such information can be used to predict the useful remaining life of that fluorescent tube. The microcontroller may be connected to a remote site computer, or otherwise connected to a vending machine audit system that monitors various vending machine functions and events. Consequently, the microcontroller may be operable to send a warning signal indicating that a fluorescent light tube is nearing the end of its useful life, or may report that a fluorescent light tube is failing or has failed to a remote site so that vending machine service personnel can take appropriate action.

The microcontroller may also be operable to detect the presence of mains power in order to reject false failure indications. In particular, the microcontroller can determine if one or more of the tubes have failed or the power to the lamp power source has been removed, thereby eliminating a false report of a tube failure. Such operation minimizes unnecessary service calls. The microcontroller also is capable of monitoring the jitter from the tube sensor in the incoming signal stream for a predetermined period of time, and if a preset threshold is exceeded within that time period then the tube is considered to be faulty. For example, if the jitter occurs more than 10 times per minute for at least thirty minutes, then the fluorescent tube is determined to be faulty. The period of time to monitor the jitter may be calculated by the microcontroller based on monitored activity up to that point in time, or based on some other criteria. Thus, when the predetermined threshold condition is exceeded within the time interval, the microcontroller recognizes a fluorescent tube failure and may generate a signal indicating tube failure to a remote location.

Several characteristics, advantages and implementations of the invention have been described. It should be understood, however, that various changes and modifications could be effected by one skilled in the art without departing from the spirit and scope of the invention.

What is claimed is:

1. A non-contact fluorescent light tube detector for a vending machine, comprising:

a photodetector circuit tuned to power line AC frequencies driving a fluorescent light;

a circuit means connected to the photodetector circuit to compensate for ambient light entering through a front panel;

an output line connected to the circuit means; and a microcontroller connected to the output line for monitoring a jitter for a time interval and for generating a fluorescent tube failure signal when the jitter exceeds a threshold value.

2. The apparatus of claim 1, further comprising at least one collimator tube for housing the detector circuit.

3. The apparatus of claim 1, wherein the circuit means for compensating for ambient light includes an automatic gain control circuit.

4. The apparatus of claim 1, wherein the circuit means for compensating for ambient light is a high pass filter.

5. The apparatus of claim 1, wherein the fluorescent tube failure signal is transmitted to a remote site.

6. The apparatus of claim 1, wherein the microcontroller is operable to detect when mains power has been removed to minimize false fluoescent tube failure signals.

7. The apparatus of claim 1, wherein the the microcontroller calculates a time interval based on monitored activity in which to monitor the jitter signal.

8. A method for detecting when at least one fluorescent light tube in a vending machine is failing, comprising:

positioning at least one light tube detector circuit that is tuned to detect power line AC frequencies driving the fluorescent light adjacent at least one of the fluorescent light tubes;

generating signals with the light tube detector;

measuring the timing of a cycling waveform induced by the fluorescent light tube to detect any jitter;

monitoring the jitter for at least one time interval; and generating a fluorescent light tube failure signal when the jitter exceeds a predetermined threshold amount within the time interval.

9. The method of claim 8, further comprising indicating that a fluorescent light tube has failed if no signals are detected and mains power has not been removed.

10. The method of claim 8, further comprising transmitting the failure signal to a remote location.

11. The method of claim 10, wherein an audit system transmits the failure signal.

12. The method of claim 8, further comprising:

logging the total amount of time that a fluorescent light tube has been illuminated; and transmitting a warning signal indicating that a light tube is nearing the end of its useful life if the time logged exceeds a predetermined threshold.

13. The method of claim 8, wherein the interval is calculated based on a monitored activity.

* * * * *